US005796296A

United States Patent [19]

Krzentz

[11] Patent Number: 5,796,296

[45] Date of Patent: Aug. 18, 1998

[54] COMBINED RESISTANCE-CAPACITANCE LADDER VOLTAGE DIVIDER CIRCUIT

[75] Inventor: Steven V. Krzentz, Dallas, Tex.

[73] Assignee: Texas Instruments Incorporated

[21] Appl. No.: 726,506

[22] Filed: Oct. 7, 1996

[51] Int. Cl.[6] ..... G05F 3/02

[52] U.S. Cl. ..... 327/545; 327/530; 327/603

[58] Field of Search ..... 327/333, 530, 327/538, 543, 545, 546, 603

[56] References Cited

U.S. PATENT DOCUMENTS

| | | | |
|---|---|---|---|
| 3,601,657 | 8/1971 | Guarino | 361/56 |
| 3,660,723 | 5/1972 | Lutz et al. | 361/9 |
| 4,956,587 | 9/1990 | Kitou et al. | 315/408 |
| 5,107,201 | 4/1992 | Ogle | 324/72.5 |

*Primary Examiner*—Timothy P. Callahan
*Assistant Examiner*—Kenneth B. Wells
*Attorney, Agent, or Firm*—Theodore D. Lindgren; Robby T. Holland; Richard L. Donaldson

[57] ABSTRACT

This invention is a voltage divider circuit having an input voltage at a first terminal ($V_{IN}$) and an output voltage at a second terminal ($V_{OUT}$). The circuit includes a parallel-connected first resistor ($R_1$) and first capacitor ($C_1$) coupled between the first and second terminals ($V_{IN}$,$V_{OUT}$) and a parallel-connected second resistor ($R_2$) and second capacitor ($C_2$) coupled between the second terminal ($V_{OUT}$) and a reference ($V_{REF}$). The ratio of the ohmic value of the second resistor ($R_2$) to the sum of the ohmic values of the first and second resistors ($R_1$,$R_2$) is substantially equal to the ratio of the value in farads of the first capacitor ($C_1$) to the sum of the values in farads of the first and second capacitors ($C_1$,$C_2$).

14 Claims, 1 Drawing Sheet

COMBINED RESISTANCE-CAPACITANCE LADDER VOLTAGE DIVIDER CIRCUIT

BACKGROUND OF THE INVENTION

The purpose of this invention is to provide a high impedance voltage divider that divides accurately for both low-frequency and high-frequency variations in the input voltage. As a result, both a transient-pulse input and its divided transient-pulse output have substantially the same shape.

FIGS. 1 and 2 illustrate a prior-art resistor voltage divider and a prior-art capacitor voltage divider, respectively. $V_{OUT}$ is the output voltage, $V_{IN}$ is the input voltage, $R_1$ and $R_2$ are resistors, $C_1$ and $C_2$ are capacitors. For the resistor divider, $V_{OUT}$ is equal to $V_{IN}R_2/(R_1+R_2)$. For the capacitor divider, $V_{OUT}$ is equal to $V_{IN}C_1/(C_1+C_2)$.

An advantage of the capacitor divider is that its output voltage does not tend to lag changes in the input voltage. A disadvantage is that, over time, any intrinsic conductive leakage across the capacitors will corrupt the ratio. Furthermore, the ratio is not valid unless the capacitor divider is initialized correctly. That is, the initial charge on the capacitors must be correct for the divider to operate properly. A typical such initial condition is $V_{OUT}=V_{IN}=0$.

A disadvantage of the resistor divider is that it draws direct current from the power supply. Minimizing this direct current requires maximizing the ohmic value of the sum of resistances $R_1+R_2$. Since there is necessarily an output capacitance connected to the output terminal $V_{OUT}$, a large ohmic value of resistor $R_2$ slows operation of the resistor divider. That is, when input voltage $V_{IN}$ changes, output voltage $V_{OUT}$ is incorrect for a period of time. That period of time may be too long for the circuit application. Another drawback to increasing the ohmic value of resistors $R_1$ and $R_2$ is that the circuit is more vulnerable to disturbances from switches and other noise sources that may couple to output voltage terminal $V_{OUT}$. One way to reduce noise sensitivity is to add a large capacitor load to output voltage terminal $V_{OUT}$. This, however, further slows the response time of the circuit.

There is a need for a voltage divider that overcomes the foregoing disadvantages.

SUMMARY OF THE INVENTION

This invention is a voltage divider circuit having an input voltage at a first terminal and an output voltage at a second terminal. The circuit includes a parallel-connected first resistor and first capacitor coupled between the first and second terminals and a parallel-connected second resistor and second capacitor coupled between the second terminal and a reference. The ratio of the ohmic value of the second resistor to the sum of the ohmic values of the first and second resistors is substantially equal to the ratio of the value in farads of the first capacitor to the sum of the values in farads of the first and second capacitors.

DETAILED DESCRIPTION OF THE INVENTION

Figure 1:
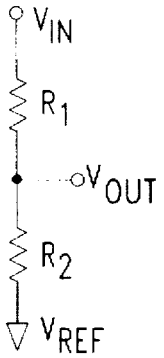
Fig.1 PRIOR ART
FIG. 1 is a prior-art resistor voltage divide.
Figure 2:
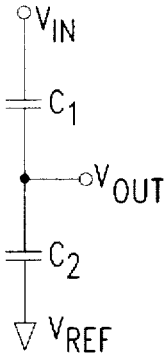
Fig.2 PRIOR ART
FIG. 2 is a prior-art capacitor voltage divider.
Figure 3:
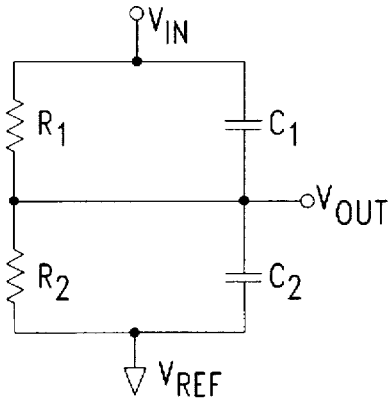
FIG. 3 is the resistance-capacitance ladder voltage divider of this invention.

An exemplary circuit of this invention is illustrated in FIG. 3. The invention combines a resistor divider $R_1$,$R_2$ and a capacitor divider $C_1$,$C_2$ in parallel. Direct current is minimized by making the resistances $R_1$ and $R_2$ large. The capacitors $C_1$ and $C_2$ reduce noise sensitivity and also cause the circuit to work correctly at high speeds. Initialization is accomplished by the resistor divider $R_1$, $R_2$. The resistor divider $R_1$, $R_2$ also maintains the voltage ratio $V_{OUT}/V_{IN}$ over an indefinite period of time. The ratio of the ohmic value of the second resistor $R_2$ to the sum of the ohmic values of the first and second resistors ($R_1+R_2$) is substantially equal to the ratio of the value in farads of the first capacitor $C_1$ to the sum of the values in farads of the first and second capacitors ($C_1+C_2$). That restriction is equivalent to restricting the time constant $R_1C_1$ to be equal to the time constant $R_2C_2$.

Note that, alternatively, the voltage at the reference terminal $V_{REF}$ may be a non-zero voltage.

Figure 4:
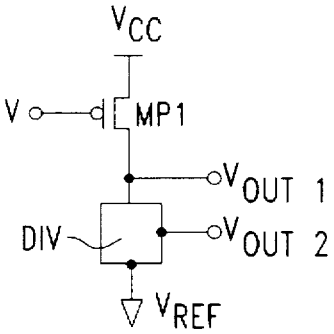
FIG. 4 illustrates a specific use of this circuit in an integrated circuit chip.
Figure 5:
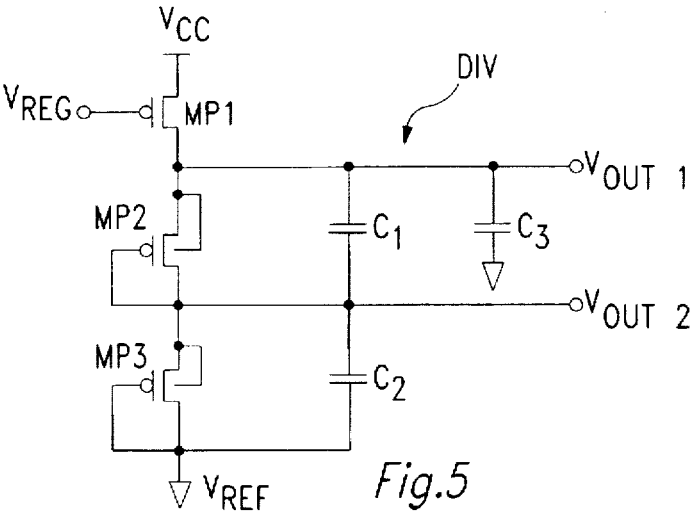
FIG. 5 illustrates construction of the circuit using P-channel diodes to conserve space.

A specific use of this circuit in an integrated circuit chip is illustrated in FIG. 4. This particular application requires a high-impedance, two-to-one voltage divider where the second voltage $V_{OUT2}$ is one-half of the first voltage $V_{OUT1}$. Voltages $V_{OUT1}$ and $V_{OUT2}$ are reference output voltages furnished by the circuit of FIG. 4 from a regulator voltage input $V_{REG}$. For stability, diode resistor MP1 and the voltage divider DIV should draw low current. Also, the voltage divider DIV acts as the pull-down on first output voltage $V_{OUT1}$. To conserve space, the resistor divider R1,R2 is constructed of P-channel diodes. The circuit is illustrated in FIG. 5, in which diode resistors MP2 and MP3 are matched, forming a two-to-one voltage divider. Capacitors $C_2$ and $C_1$ are also matched, forming a second two-to-one divider. Capacitor $C_3$ further stabilizes $V_{OUT1}$ and may have any value.

Resistors $R_1$ and $R_2$ each have an intrinsic capacitance determined primarily by the size and type of source-drain diffusion used for construction of the P-channel diodes used in the example embodiment. The intrinsic capacitance of resistor $R_1$ should be less than about one-tenth of the capacitance of capacitor $C_1$. If not, the intrinsic capacitance of resistor $R_1$ should be subtracted from the design value of capacitor $C_1$. Similarly, the resistor $R_2$ and the load should either have intrinsic capacitances that total less than about one-tenth of the design value for capacitance of capacitor $C_2$. If not, those intrinsic capacitances should be subtracted from the design value for capacitance of capacitor $C_2$.

Capacitors $C_1$ and $C_2$ each have an intrinsic conductance determined primarily by insulator and/or junction leakage. The intrinsic conductance of capacitor $C_1$ should be less than about one-tenth of the design value of the conductance of resistor $R_1$. If not, the intrinsic conductance of capacitor $C_1$ should be subtracted from the design value for conductance of resistor $R_1$. Similarly, the capacitor $C_2$ and the load should either have intrinsic conductances that total less than about one-tenth of the design value for conductance of resistor $R_2$. If not, those intrinsic conductances should be subtracted from the design value for conductance of resistor $R_2$.

While this invention has been described with respect to an illustrative embodiment, this description is not intended to be construed in a limiting sense. Upon reference to this description, various modifications of the illustrative embodiment, as well as other embodiments of the invention, will be apparent to persons skilled in the art. It is contemplated that the appended claims will cover any such modifications or embodiments that fall within the scope of the invention.

I claim:

1. A voltage divider circuit providing an output voltage at a second terminal in response to a voltage applied between a first terminal and a third terminal, said circuit comprising:

a first resistor and a first capacitor, said first resistor having a first ohmic value and said first capacitor having a first farad value, each of said first resistor and said first capacitor coupled between said second terminal and said first terminal; and a second resistor and a second capacitor, said second resistor having a second ohmic value and said second capacitor having a second farad value, each of said second resistor and said second capacitor coupled between said second terminal and said third terminal;

the ratio of second ohmic value to the sum of said first ohmic value and of said second ohmic value being substantially equal to the ratio of said first farad value to the sum of said first farad value and of said second farad value.

2. The circuit of claim 1, wherein said first resistor and said second resistor are P-channel, diode-connected, field-effect transistors.

3. The circuit of claim 1, wherein said first resistor and said second resistor are identical P-channel, diode-connected, field-effect transistors.

4. The circuit of claim 1, wherein said first capacitor and said second capacitor are field-effect transistors.

5. The circuit of claim 1, wherein said first capacitor and said second capacitor are identical field-effect transistors.

6. The circuit of claim 1, wherein said second voltage is ground voltage.

7. The circuit of claim 1, wherein said first voltage, said second voltage and said output voltage are equal prior to a change in said first voltage.

8. A voltage divider circuit providing an output voltage at a second terminal in response to a voltage applied between a first terminal and a third terminal, said circuit comprising:

a first resistor and a first capacitor, said first resistor having a first ohmic value and said first capacitor having a first farad value, each of said first resistor and said first capacitor coupled between said second terminal and said first terminal; and a second resistor and a second capacitor, said second resistor having a second ohmic value and said second capacitor having a second farad value, each of said second resistor and said second capacitor coupled between said second terminal and said third terminal;

the product of said first ohmic value and said first farad value being substantially equal to the product of said second ohmic value and said second farad value.

9. The circuit of claim 8, wherein said first resistor and said second resistor are P-channel, diode-connected, field-effect transistors.

10. The circuit of claim 8, wherein said first resistor and said second resistor are identical P-channel, diode-connected, field-effect transistors.

11. The circuit of claim 8, wherein said first capacitor and said second capacitor are field-effect transistors.

12. The circuit of claim 8, wherein said first capacitor and said second capacitor are identical field-effect transistors.

13. The circuit of claim 8, wherein said second voltage is ground voltage.

14. The circuit of claim 8, wherein said first voltage, said second voltage and said output voltage are equal prior to a change in said first voltage.

* * * * *